US006526239B2

(12) United States Patent
Shiiya

(10) Patent No.: US 6,526,239 B2
(45) Date of Patent: Feb. 25, 2003

(54) THERMO-PRESSURE FIXING TYPE PRINTER

(75) Inventor: Tomoyuki Shiiya, Saitama-ken (JP)

(73) Assignee: Pentax Corporation, Tokyo (JP)

( * ) Notice: Subject to any disclaimer, the term of this patent is extended or adjusted under 35 U.S.C. 154(b) by 0 days.

(21) Appl. No.: 09/949,773

(22) Filed: Sep. 12, 2001

(65) Prior Publication Data

US 2002/0031361 A1 Mar. 14, 2002

(30) Foreign Application Priority Data

Sep. 13, 2000 (JP) ..... 2000-278214

(51) Int. Cl.[7] ..... G03G 15/20
(52) U.S. Cl. ..... 399/67; 399/328; 399/384
(58) Field of Search ..... 399/67, 68, 320, 399/328, 384, 400, 16

(56) References Cited

U.S. PATENT DOCUMENTS 5,063,416 A 11/1991 Honda et al. ..... 399/384
5,315,359 A 5/1994 Nishikawa ..... 399/323
5,432,593 A * 7/1995 Nishikawa et al. ..... 399/328
5,488,467 A * 1/1996 Marentes et al. ..... 399/328 X
5,493,377 A 2/1996 Nishikawa et al. ..... 399/328
5,835,835 A * 11/1998 Nishikawa et al. ..... 399/328 X
5,926,680 A * 7/1999 Yamamoto et al. ..... 399/328 X

FOREIGN PATENT DOCUMENTS

JP 08-123247 * 5/1996

* cited by examiner

*Primary Examiner*—Sophia S. Chen
(74) *Attorney, Agent, or Firm*—Greenblum & Bernstein, P.L.C.

(57) ABSTRACT

In an imaging apparatus for forming an image on a continuous recording sheet, in accordance with an electrophotographic imaging process, and fixing the image on the continuous recording sheet by applying heat and pressure using a pair of fixing rollers including a heat roller and a pressure roller, when a printing operation is finished, the printing portion of the recording sheet is discharged from the printer and the heat roller is moved from an operable position, where it is press-contacted with a pressure roller, to a retracted position, where it is spaced from the pressure roller by a predetermined amount. When the heat roller is moved toward the retracted position, it is once stopped at an intermediate position for a predetermined period of time, and then, moved further to the retracted position. Another printing operation is started, the recording sheet is pulled back so that images are formed thereon.

5 Claims, 13 Drawing Sheets

THERMO-PRESSURE FIXING TYPE PRINTER

BACKGROUND OF THE INVENTION

The present invention relates to a thermo-pressure fixing type printer, which forms images on a continuous form recording sheet and fixes the images thereon using a heat roller and a pressing roller.

Conventionally, an electrophotographic imaging apparatus which forms images in accordance with a so-called electrophotographic imaging method. In such imaging apparatus, a photoconductive member on the surface of a photoconductive drum is exposed to light to form a latent image thereon, which is developed by applying toner to form a toner image. Then, the developed toner image is transferred onto a recording medium such as a recording sheet or recording paper, and fixed thereon using a fixing unit.

As an example of such an imaging apparatus, a printer that prints images sequentially onto each segment (i.e., page) of a continuous form recording sheet (hereinafter referred to as a continuous recording sheet) has been known. Generally, such a printer is configured to feed the continuous recording sheet by a feeding unit such as a tractor unit that drives a tractor belt. Next to the feeding unit, a pair of fixing rollers (i.e., heat roller and pressure roller) are provided to apply heat and pressure to the continuous recording sheet bearing the images and passing therebetween.

Typically, the heat roller of the pair of fixing rollers is driven to rotate at a constant speed so that the continuous sheet nipped between the heat roller and the pressure roller is fed toward the direction similar to the feeding direction of the feeding unit.

In such a printer, if the continuous sheet is nipped between the heat roller and the pressure roller when feeding of the continuous sheet is terminated, the continuous sheet may be scorched as the continuous sheet is overheated. In order to prevent the continuous sheet from scorching, in a conventional printer, the heat roller and the pressure roller are spaced apart when the feeding of the continuous sheet is stopped so that the same portion of the continuous sheet is not held in the nip between the heat roller and the pressure roller. When the feeding is restarted, feeding by the feeding unit and the rotation of the heat roller are started firstly, and then, the heat roller and the pressure roller are brought into an operable condition (i.e., brought into contact) so that the continuous sheet is nipped therebetween and fed thereby.

Some printers are configured to discharge all the pages bearing images before the sheet feeding is stopped so that users can check all the printed images and/or cut off all the pages bearing the printed images. After the printed images are checked or the printed pages are cut off, and the following printing job is to be restarted, the top page of the continuous sheet bearing no image and remaining in the printer is pulled back to the transfer position so that the image is formed from the top page of the unprinted sheet, thereby no blank (non-printed) page being generated.

Generally, when the continuous sheet is heated by the pair of fixing roller, especially in a high temperature and high humidity atmosphere, the continuous sheet shrinks at the heated portion due to the evaporation of the moisture in the continuous sheet.

If the positional relationship between the heat roller and the pressure roller is constant, the heat and pressure applied to the continuous sheet is evenly distributed in the width direction. Thus, the continuous sheet shrinks substantially uniformly across the width direction. In such a case, no crinkles may be formed on the continuous sheet. However, if the heat roller and the pressure roller are moved to apart from each other, distribution of the heat and the pressure applied to the continuous sheet may be changed in the width direction as the heat roller and the pressure roller move. In this case, crinkles may likely be formed in the continuous sheet.

In the above-described type printer, i.e., the printer in which the leading edge of the non-printed page of the continuous sheet is fed back when the printing is restarted, the heat is applied to the continuous sheet as follows. When a printing job is finished, the rollers are moved apart relative to each other. At this stage, a perforated portion between a trailing edge of the printed page and a leading edge of the non-printed page is heated. Due to the unevenly distributed heat applied to the continuous recording sheet, crinkles are formed at the leading edge portion of the non-printed page. It should be noted that a perforation line typically includes a plurality of incisions evenly aligned in the width direction, and therefore, occurrence of the crinkles are significant.

If another printing job is restarted with this condition, the continuous sheet is fed back so that the leading edge of the non-printed page is located on an upstream side of the photoconductive drum, and then, fed forward so that the electrophotographic imaging process is performed. Since the crinkles are formed on the leading edge portion of the non-printed page as described above, valley portions of the crinkles may not contact the photoconductive drum, and therefore, the toner image may not be transferred onto the valley portions.

SUMMARY OF THE INVENTION

It is therefore an object of the invention to provide an improved electrophotographic printer in which the trailing edge of the printed page is discharged from the printer when a printing operation is terminated, and the continuous sheet is retracted so that the leading edge of the non-printed page is located on the upstream side of the photoconductive drum when the printing operation is restarted, the above-described deficiency is prevented.

For the above object, according to the invention, there is provided an imaging apparatus for forming an image on a continuous recording sheet, in accordance with an electrophotographic imaging process, and fixing the image on the continuous recording sheet by applying heat and pressure using a pair of fixing rollers including a heat roller and a pressure roller. The imaging apparatus is configured such that, when a printing operation is terminated, a trailing end of a printed portion of the continuous recording sheet is passed through the fixing unit and discharged from the printer. When another imaging operation is to be executed, the continuous recording sheet is reversely fed until a leading end of a non-printed portion of the continuous recording sheet is located at a predetermined upstream position with respect to a transfer position so that image formation can be executed from the non-printed portion. In such an imaging apparatus, when a printing operation is finished, and the printed portion of the recording sheet is discharged from the printer, the heat roller is moved from an operable position, where it is press-contacted with a pressure roller, to a retracted position, where it is spaced from the pressure roller by a predetermined amount. It should be noted that, when the heat roller is moved toward the retracted position, it is once stopped at an intermediate position between the operable position and the retracted position for a predetermined period of time, and then, moved further to the retracted position.

According to the above configuration, since the retracting movement of the heat rollers Is divided into a plurality of movements, the crinkles will not be formed on the leading edge portion of the non-printed page when fixing rollers are brought into the retracted state.

Optionally, the at least one intermediate position may include a position at which the heat roller and the pressure roller contact the recording sheet at a position close to the trailing end of the printed portion.

Further optionally, the roller driving mechanism may include a pair of arm members swingable about an axis. The one of the heat roller and pressure roller is supported at an end portion of the pair of arms, the one of said heat roller and pressure roller being swung as the pair of arm members swing about the axis.

In a particular case, the roller driving mechanism may include a cam mechanism which may include a rotating cam which is rotatable about a rotation axis, and a cam rotating system that rotates said rotating cam at a predetermined constant speed. The rotating cam is formed to have an arc-shaped cam portion, which is centered about the rotation axis.

Further optionally, the roller driving mechanism may include a cam mechanism, which is provided with a cam member formed with a cam profile, a driving system that drives said cam member to move, a cam position detecting system that detects a position of said cam member, and a control system that controls movement of said cam member. The control system may control the driving system to stop driving the cam member for a predetermined period of time when the cam position detecting system detects that the cam member is located at a predetermined position.

Still optionally, the imaging apparatus may perform image formation on a page basis, the page being defined as a segment on the recording sheet divided by perforation lines formed thereon at predetermined intervals.

BRIEF DESCRIPTION OF THE ACCOMPANYING DRAWINGS

Figure 14:
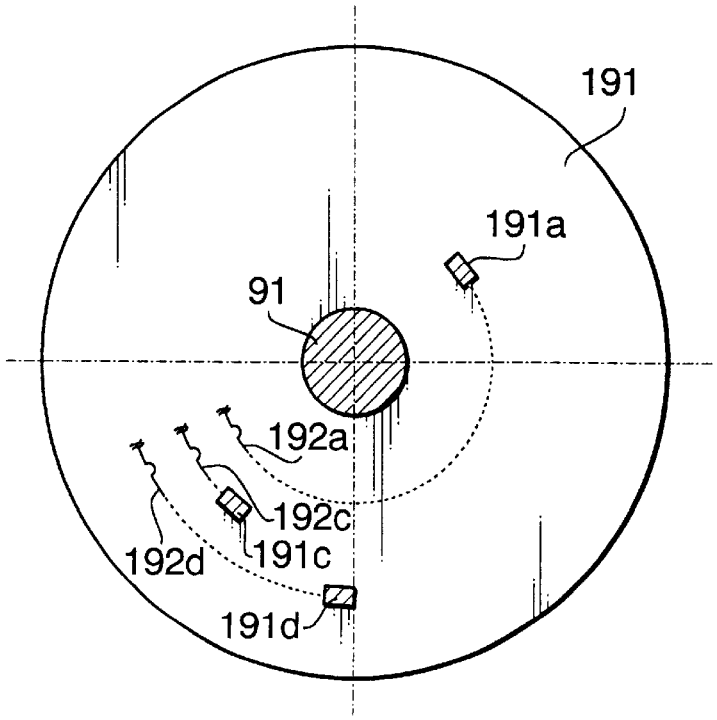

FIG. 14 schematically shows a structure of the code plate; and

Figure 15:
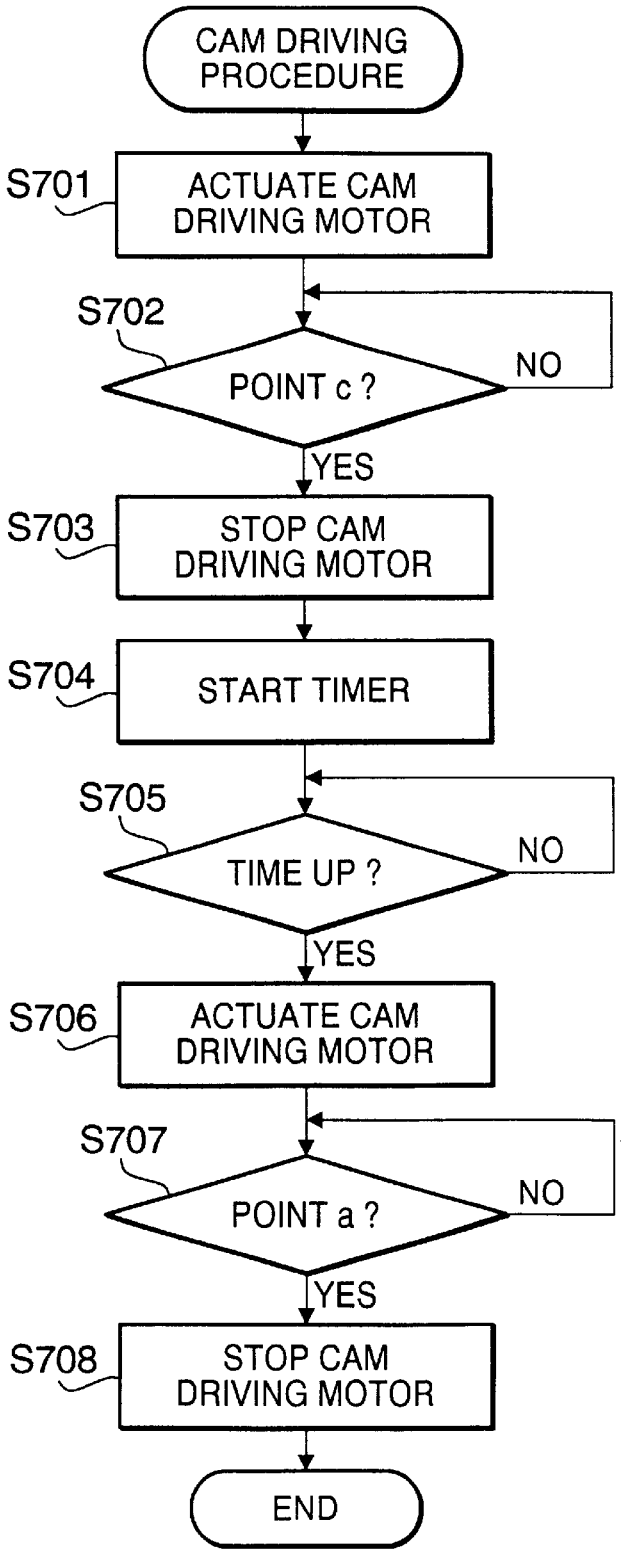

FIG. 15 shows a flowchart illustrating a cam driving procedure according to the second embodiment.

DETAILED DESCRIPTION OF THE EMBODIMENTS

Hereinafter, a laser beam printer 10 according to an embodiment of the present invention will be described with reference to the accompanying drawings.

Figure 1:
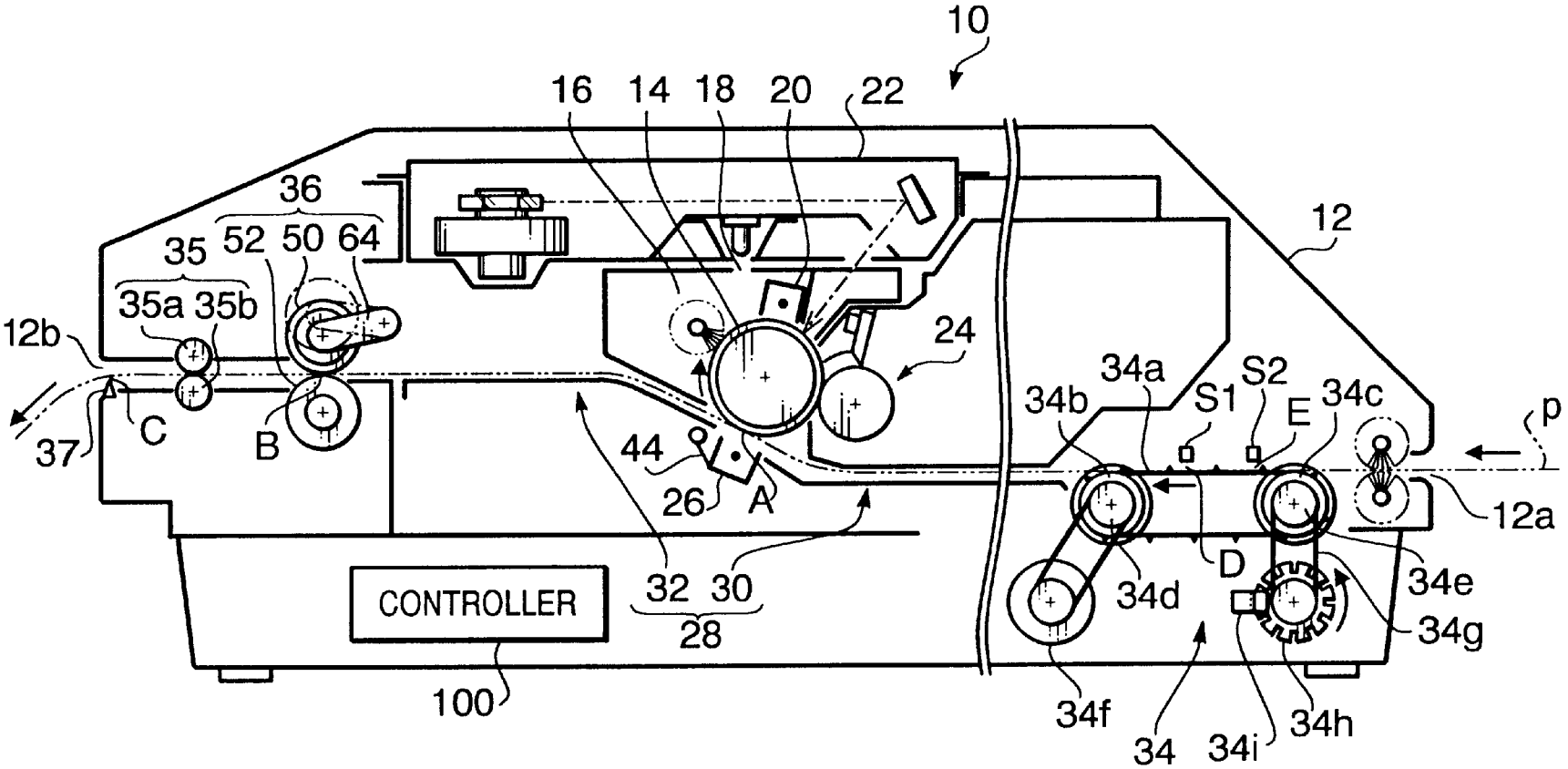
FIG. 1 shows a basic structure of a laser beam printer according to an embodiment of the invention.

FIG. 1 shows a basic structure of the laser beam printer 10. The laser beam printer 10 forms images, in accordance with image data received from a computer or the like, on a continuous recording sheet P in accordance with the electrophotographic image forming process to output a hard copy of the images. The continuous recording sheet P is, for example, a fan-fold sheet, which has a plurality of segments (i.e., pages) divided by perforation lines, and is stacked outside the laser beam printer 10 as folded at the perforation lines.

The laser beam printer 10 has a housing 12 in which a photoconductive drum 14 is provided. The photoconductive drum 14 is driven to rotate, by a main motor (not shown), at a constant peripheral speed. Around the photoconductive drum 14, along a rotating direction thereof, a toner cleaning unit 16, a discharging unit 18, a charging unit 20, a laser scanning unit 22, a developing unit 24, and a transfer unit 26 are provided.

The toner cleaning unit 16 cleans up the residual toner remaining on the circumferential surface (photoconductive surface) of the photoconductive drum 14. The discharging unit 18 discharges the electric charges on the photoconductive surface of the photoconductive drum 14. The charging unit 20 charges uniformly the photoconductive surface of the photoconductive drum 14. The laser scanning unit 22 includes a scanning optical system for scanning the laser beam on the photoconductive drum 14 in a direction parallel to the rotational axis thereof. The developing unit 24 develops an electrostatic latent image formed on the photoconductive drum 14 by applying toner thereonto. The transfer unit 26 transfers the developed image (i.e., the toner image) onto the continuous recording sheet P.

The transfer unit 26 is disposed substantially beneath the photoconductive drum 14, and a transfer position A is defined between the photoconductive drum 14 and the transfer unit 26. A sheet feeding path 28, along which the continuous recording sheet P is fed, passes the transfer position A and extends towards left- and right-hand directions in FIG. 1. The sheet feeding path 28 includes an inlet side feeding path 30 and an outlet side feeding path 32.

In FIG. 1, the inlet side feeding path 30 is on the right-hand side, or the upstream side along the feeding direction, with respect to the transfer position A. The outlet side feeding path 32 is on the left-hand side, or the downstream side along the feeding direction, with respect to the transfer position A.

A tractor unit 34 is disposed in the inlet side feeding path 30. The tractor unit 34 feeds the continuous recording sheet P entering from a sheet inlet 12*a*, which is formed at the right-hand side of the housing 12 in FIG. 1, to the transfer position A.

A fixing unit 36 is disposed in the outlet side feeding path 32. The fixing unit 36 fixes the toner image transferred on the continuous recording sheet P. A discharging roller mechanism 35 having an upper discharging roller 35*a* and a lower discharging roller 35*b* is provided to the outlet side feeding path 32, on the downstream side, in the feeding direction, of the fixing unit 36. The discharging roller mechanism 35 feeds the continuous recording sheet P to discharge the same from the sheet outlet 12*b* formed at the left-hand side of the housing 12 in FIG. 1. A sheet cutter 37 is provided at the sheet outlet 12*b*. Thus, users can cut out the continuous sheet P using the sheet cutter 37 to take the printed part of the sheet P after a printing operation is completed.

In the laser beam printer 10 constructed as above, the continuous recording sheet P is drawn into the laser beam printer 10 through the sheet inlet 12*a*. Then the continuous recording sheet P is fed along the feeding path 28 towards the sheet outlet 12*b* by the tractor 34. The laser scanning unit 22 scans the laser beam onto the photoconductive surface of the photoconductive drum 14 to form a latent image thereon. Specifically, the laser scanning unit 22 scans the laser beam in a main scanning direction which is parallel to a rotation axis of the photoconductive drum 14. At the same time, the photoconductive drum 14 is driven to rotate about its rotation axis so that the laser beam is also scanned in an auxiliary scanning direction. As the result of the scanning operation in the main and auxiliary scanning directions, a two-dimensional latent image is formed on the photoconductive surface of the photoconductive drum 14. Then, the developing unit 24 develops the latent image by applying toner to the image to form a toner image. The transfer unit 26 is actuated to transfer the toner image from the photoconductive drum 14 onto the continuous recording sheet P, which is fed along the feeding path 28. Then, the fixing unit 36 fixes the toner image onto the continuous recording sheet P by applying heat and pressure.

The tractor unit 34 includes a pair of driving shafts 34*d* and 34*e* arranged parallel to each other, a pair of feeding rollers 34*b* and 34*c* are attached onto the driving shafts 34*d* and 34*e*, respectively, and a pair of tractor belts 34*a* (only one is shown in FIG. 1) are wound around the feeding rollers 34*b* and 34*c*. Each of the tractor belts 34*a* has a plurality of projections which engage with the feed holes of the continuous recording sheet P. The feed holes are formed along both sides of the continuous recording sheet P along the feeding direction, at constant intervals (e.g., at ½ inches).

One of the feeding rollers 34*b* and 34*c* (the roller 34*b* in this embodiment) is connected with a driving motor 34*f* that is rotatable in either forward or reverse direction. Thus, the feeding roller 34*b* can be driven to rotate in either forward or reverse direction. When the feeding roller 34*b* is rotated in the forward direction (in the counterclockwise direction in FIG. 1), the continuous recording sheet P is fed towards the sheet outlet 12*b*, and when the feeding roller 34*b* is rotated in the reverse direction (in the clockwise direction in FIG. 1), the continuous recording sheet P is fed back towards the sheet inlet 12*a*.

The other one of the two feeding rollers, i.e. feeding roller 34*e* in the embodiment, is connected with an encoder 34*h* by an endless-belt 34*g* so that the encoder 34*h* rotates as the feeding roller 34*e* rotates. The encoder 34*h* is a disk-shaped plate member formed with a plurality of slits at the periphery thereof. Each slit corresponds to one of the projections of the tractor belt 34*a*. That is, when the continuous recording sheet P is fed by an amount corresponding to a pitch of the projections of the tractor belt 34*a* (i.e., by ½ inches), the encoder 34*h* rotates by an amount corresponding to the pitch of the slits. A photo-interrupter 34*i* having a light emitting device and a light receiving device is provided such that the periphery of the encoder 34*h* is placed between the light emitting device and the light receiving device. In the present embodiment, the feeding speed of the continuous recording sheet P is obtained from the output signal of the photo-interrupter 34*i* that detects the passage of the slit of the encoder 34*h*, instead of the revolving speed of the motor 34*f*. Specifically, according to the embodiment, every time when the continuous recording sheet P is fed by ½ inches, one pulse signal is output by the photo-interrupter 34*i*.

The transfer unit 26 includes a corona charger of which length, in the width direction of the continuous recording sheet P, is substantially the same as the length of the photoconductive drum 14. The corona charger is held by a swingable arm member 44 at both ends thereof such that the corona charger is disposed parallel to, but a certain distance spaced from, the photoconductive surface of the photoconductive drum 14. By means of a driving mechanism (not shown), the corona charger can be swung to locate at an operable position (i.e., transfer position) and a retracted position, which is further spaced from the photoconductive drum 14, where the corona charger is retracted from the operable position.

It should be noted that the length of the feeding path between the position where the toner image is transferred onto the continuous recording sheet P by the transfer unit 26 and the position where the toner image is fixed to the continuous recording sheet P by the fixing unit 36 (i.e., the length of the outlet side feeding path 32) is shorter than the shortest interval of the perforation lines (i.e., a length of a page) of the continuous recording sheets P which can be used by the laser beam printer 10.

The fixing unit 36 includes a pair of fixing rollers 54, i.e., a heat roller 50 and a pressure roller 52 disposed beneath the heat roller 50. Both the heat roller 50 and pressure roller 52 are arranged such that their rotation axes are perpendicular to the feeding direction of the continuous recording sheet P. When the continuous recording sheet P is nipped between the pair of fixing rollers 54, heat and pressure are applied to the continuous recording sheet P and the toner image is fixed thereon.

After the toner image is fixed by the fixing unit 36, the continuous recording sheet P passes through a nip between the upper discharging roller 35*a* and the lower discharging roller 35*b*. The upper discharging roller 35*a* is driven to rotate by the same motor that drives the heat roller 50. A gear mechanism (not shown) keeps the peripheral speed of the upper discharging roller 35*a* at the same speed as the feeding speed of the continuous recording sheet P, which is fed by the tractor unit 34. Accordingly, the continuous recording sheet P is held between the upper and lower discharging rollers 35*a* and 35*b*, and fed towards the sheet outlet 12*b* at the feeding speed which is the same as that defined by the tractor unit 34. It should be noted that the discharging roller mechanism 35 is provided with a roller separating mechanism (not shown), which lifts up the upper discharging roller 35*a* to be spaced from the lower discharging roller 36*b* when the continuous recording sheet P is reversely fed towards the sheet inlet 12*a* so that the discharging roller mechanism 35 does not disturbs the reverse movement of the tractor unit 34.

Two sensors for detecting the presence/absence of the continuous recording sheet P, i.e. a paper top sensor S1 and a paper end sensor S2, are provided to the inlet side feeding path 30, spaced apart from each other along the feeding direction. The paper end sensor S2 is located between the paper top sensor S1 and the sheet inlet 12*a*.

A home position D is defined as a position between the paper top sensor S1 and the paper end sensor S2, to which one of the perforation lines formed on the continuous recording sheet P, preferably the perforation line formed on the upstream side of the top page of the non-printed part (i.e., the leading end of the top page), is positioned when the laser beam printer 10 starts printing.

Figure 2:
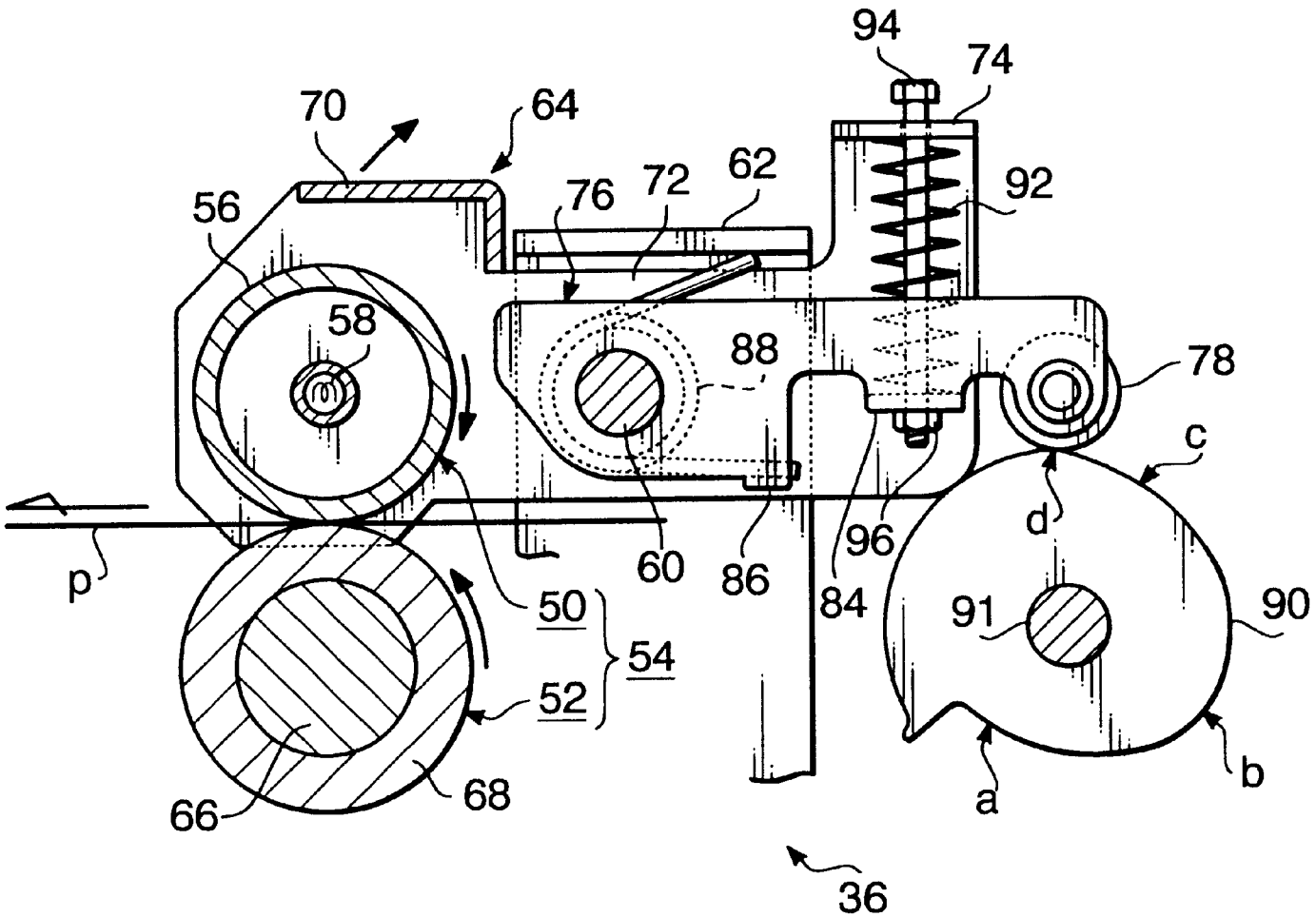
FIG. 2 shows the structure of the fixing unit employed in the printer shown in FIG. 1 in detail.

FIG. 2 shows the structure of the fixing unit 36 in detail. The heat roller 50 has a cylindrical roller body 56 and a halogen lamp 58. The halogen lamp 58 serves as a heat source for heating the roller body 56 so that the outer circumferential surface of the roller body 56 is heated up to a required temperature. A holder 64 is swingably mounted on a chassis 62 by a shaft 60 and rotatably supports the heat roller 50. Thus, the heat roller 50 is supported, swingably with respect to the chassis 62, by the holder 64. One axial end of the heat roller 50 is connected to a gear mechanism (not shown) which transmits the driving force for rotating the heat roller 50 from a motor (not shown).

The pressure roller 52, disposed below the heat roller 50, has a core bar 66 and an elastic heat resistive layer 68, such as silicon rubber, is provided around the core bar 66. The pressure roller 52 is rotatably supported by the chassis 62 at a fixed position.

The holder 64 has a connection portion 70, which is substantially as long as the axial length of the heat roller 56 and connects two side walls that support the axial end portions of the heat roller 56. Two arms 72 (only one of which is shown in FIG. 2) extend from the side of the connection portion 70 in a direction opposite to the feeding direction (i.e., to a right-hand direction in FIG. 2). Each of the arms 72 is swingably mounted at its middle portion on the chassis 62 by the shaft 60. The shaft 60 is arranged such that its central axis is parallel to the rotation axis of the heat roller 50. A spring receiver 74 is provided to each end of the arms 72. Each spring receiver 74 extends upwardly from the end of the arm 72 and then is bent, preferably at a right angle, toward inside (i.e., toward the opposite one) of the arms 72.

Two levers 76 are disposed parallel to the feeding direction between the arms 72. One end portion of each lever 76 is supported by the shaft 60 such that the levers 76 can swing. To the other end portion of the lever 76, a cam follower 78 is rotatably provided. A spring holding portion 84 is provided to the lever 76 at a part below the spring receiver 74 of the holder 64. The spring holding portion 84 protrudes downwardly from the lever 76 and then bent outwardly (i.e., towards the arm 72). A hook 86 is provided to the lever 76 near the portion to which the shaft 60 is connected. The hook 86 is a protruded portion bent outwardly (i.e., towards the arm 72).

Figure 6:
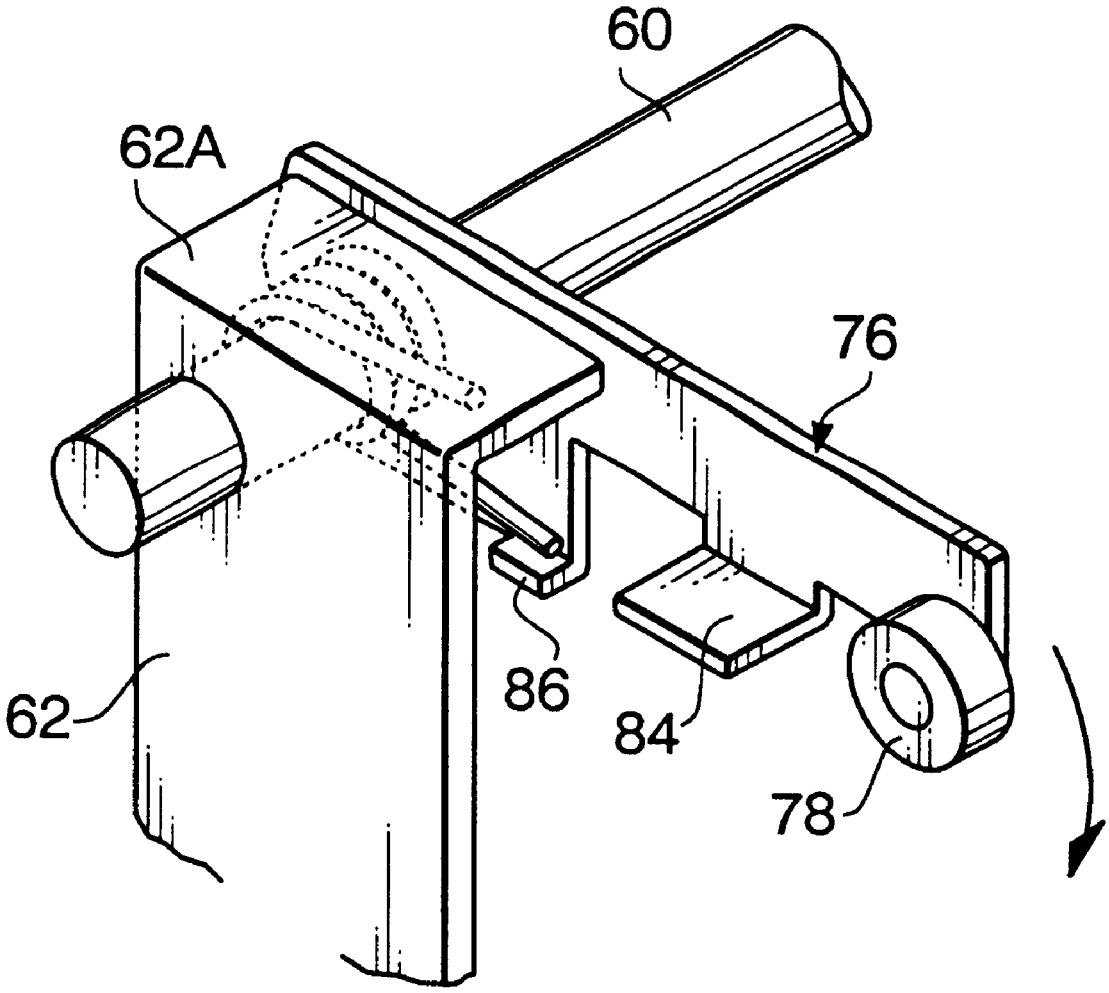
FIG. 6 shows a detailed structure of chassis and a swingable lever provided with a cam follower.

As shown in FIG. 6, a torsion spring 88 is arranged around the shaft 60 to apply urging force between lever 76 and the chassis 62. One end of the torsion spring 88 contacts the top surface of the hook 86 formed to the lever 76. The other end of the torsion spring 88 contacts the bottom surface of a hook 62A of the chassis 62. The hook 62A is formed by bending a portion extending from the top of the chassis 62 towards the lever 76. In such a configuration, the torsion spring 88 urges the lever 76 to rotate around the shaft 60 in clockwise direction in FIG. 6. As a result, the cam follower 78 mounted at the end of the lever 76 is biased towards and press-contacts the peripheral surface of a rotating cam 90 (see FIG. 2).

As shown in FIG. 2, the spring receiver 74 of the holder 64 and the spring holding portion 84 of the lever 76 are connected using a bolt 94 and a nut 96. The bolt 94 and the nut 96 limit the maximum distance between the spring receiver 74 and the spring holding portion 84, and thus limit the maximum relative swinging angle of the lever 76 with respect to the holder 64. A coil spring 92 is disposed around the bolt in a compressed state so that the holder 64 is urged to move away from the lever 76. In other words, the holder 64 rotates, due to the biasing force of the coil spring 92, in the direction where the heat roller 50 moves towards the pressure roller 52 (in a downward direction in FIG. 2).

Since the torsion spring 88 biases the lever 76 in clockwise direction in FIG. 2, the cam follower 78 is urged to contact the rotating cam 90. As the rotating cam 90 rotates, the cam follower 78 moves up and down along the cam surface of the rotating cam 90, which results in the swinging motion of the lever 76 around the shaft 60. The swinging motion of the lever 76 is transmitted to the holder 64 via the bolt 94 and nut 96 and/or the coil spring 92. Thus, the holder 64 also swings around the shaft 60.

As the cam follower 78 gradually moves upward following the cam surface of the rotating cam 90, the holder 64 swings and the heat roller 50 supported by the holder 64 gradually moves downward. When the heat roller contacts the pressure roller 52, the holder 64 stops swinging. The further upward movement of the cam follower 78 after the holder 64 has stopped swinging results in further compression of the coil spring 92. This compression of the coil spring controls the pressure that the heat roller 50 applies to the pressure roller 52.

First Embodiment

Figure 4:
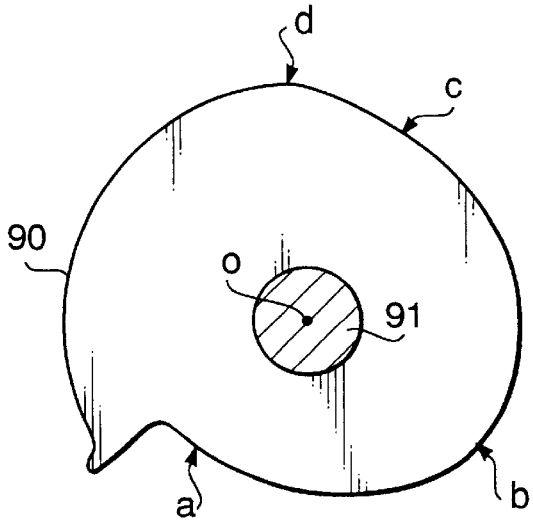
FIG. 4 shows a shape of a rotating cam.

FIG. 4 shows the rotating cam 90 according to a first embodiment. The cam surface of the rotating cam 90 includes at least three regions. In the first region, which is defined as a region between points a and b, the distance from the rotation axis o of the rotating cam 90 to the cam surface gradually increases from point a to point b.

In the second region, which is a region between points b and c, the cam surface is defined as a part of the surface of a cylinder of which the center axis coincides with the rotation axis o. Thus, the distance from the rotation axis o to the cam surface is constant over the second region. The distance from the rotation axis o to the cam surface in the second region is defined such that, if the cam follower 78 contacts the second region, then the heat roller 50 contacts the pressure roller 52 with the minimum pressure required for fixing the toner image onto the continuous recording sheet P.

The third region is a region between points c and d. In the third region, the distance from the rotation axis o to the cam surface gradually increases again from point c to point d.

The cam surface of the rotating cam 90 is configured such that it is most spaced from the rotation axis o of the rotating cam 90 at point d as shown in FIG. 2. When the cam follower 78 contacts the rotating cam 90 at point d (at this moment the cam follower 78 is at its highest position), the circumferential surface of the heat roller 50 contacts the circumferential surface of the pressure roller 52. At this stage, the coil spring 92 is compressed such that the pressure between the heating roller 50 and the pressure roller 52 is optimal for fixing the toner image onto the continuous recording sheet P.

Figure 3:
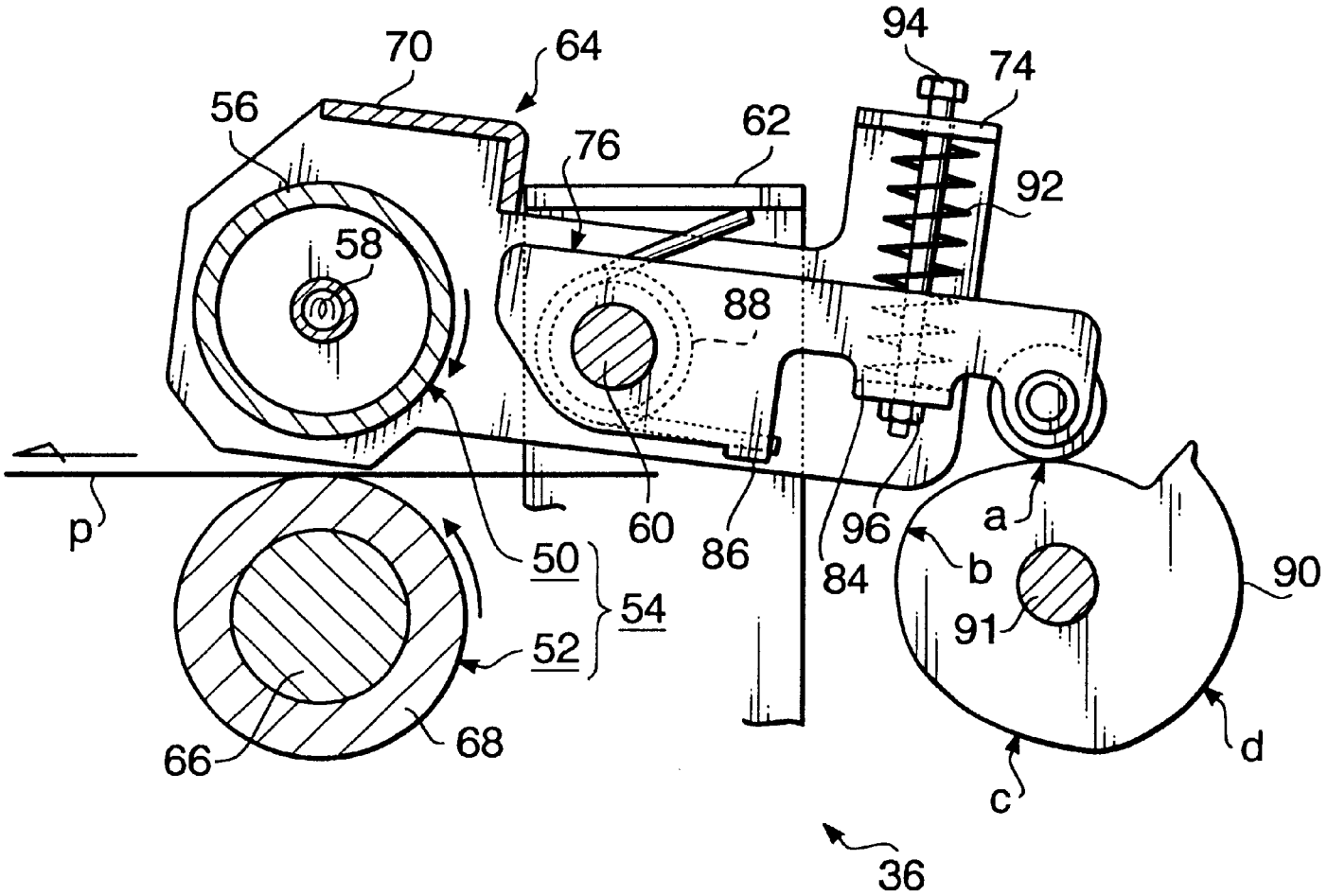
FIG. 3 shows the structure of the fixing unit employed in the printer shown in FIG. 1 when arm members are swung.

The cam surface of the rotating cam 90 is least spaced from the rotation axis o of the rotating cam 90 at point a as shown in FIG. 3. At this stage, the cam follower is at its lowest position. In this case, the lever 76 swings in clockwise direction in FIG. 3 and drives the holder 64 through the bolt 94 and nut 96 so that the holder 64 also rotates in a clockwise direction. As a result, the heat roller 50 is lifted up by the holder 64, moved away from the pressure roller 52 so that the heat roller 50 does not contact the pressure roller 52 any more.

The rotation angle of the rotating cam 90 is controlled by a controller 100 (FIG. 1), which receives signals from various sensors and controls the actuation of various mechanism or circuits such as the tractor 34, the laser scanning unit 22, and the pair of fixing roller 54. When the printing (image forming) operation is performed, the controller 100 controls the rotation angle of the rotating cam 90 such that the cam follower 78 contacts the rotating cam 90 at point d, and thereby the heat roller 50 is pressed against the pressure roller 52 at the optimum pressure for fixing the toner image onto the continuous recording sheet P. When the printing operations is not performed, the controller 100 controls the rotation angle of the rotating cam 90 such that the cam follower 78 contacts the rotating cam 90 at point a, thereby the heat roller 50 being located at a retracted position where the heat roller 50 is spaced from the pressure roller 52.

At the end of printing operation, the controller 100 controls the rotating cam 90 to rotate at a constant speed such that the contact position of the cam follower 78 with respect to the rotating cam 90 changes from point d to point a. During this movement, the controller 100 controls so that the cam follower 78 passes point c when the end of the printed region of the continuous recording sheet P passes the nip between the heat roller 50 and the pressure roller 52.

Figure 5:
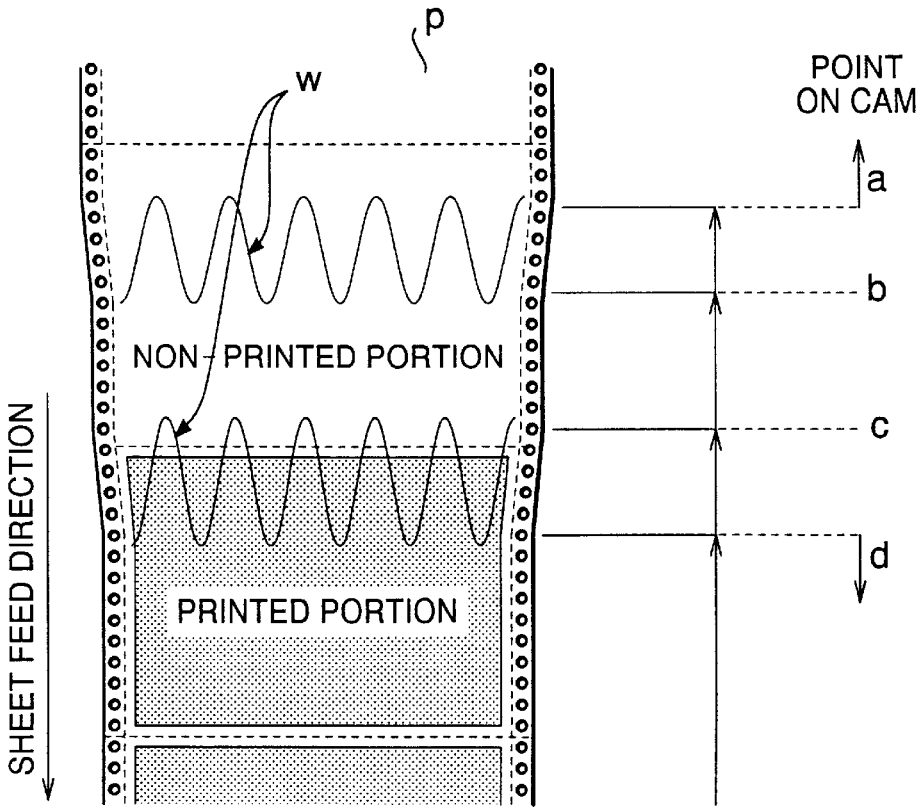
FIG. 5 shows a relationship of crinkles formed on a recording sheet and cam positions.

As shown in FIG. 5, when the rotating cam 90 rotates so that the heat roller 50 gradually lifts up, crinkles w appear on the continuous recording sheet P. The zone in which the crinkles w appear is divided into two small zones with a zone having no crinkles located therebetween. The zone having no wrinkles is formed since the lever 76 does not swing when the cam follower 78 follows the second region (i.e., from point c to point b) of the rotating cam 90, and therefore the pressure and heat applied from the heat roller 52 to the continuous recording sheet P do not change.

In the two small crinkle zones w, the amount of shrink of the continuous recording sheet P in the width direction is relatively small compared to that in one large crinkle zone formed in a conventional printer. Therefore, the crinkles formed in the zones w are also relatively small and deep valleys do not appear, to which toner image is hardly transferred to cause defects in the printed image.

FIGS. 7 through 12 are flowcharts illustrating procedures of the laser beam printer 10. The illustrated procedures are stored, in a form of programs, for example, in the ROM of the controller 100, and executed thereby.

Figure 7:
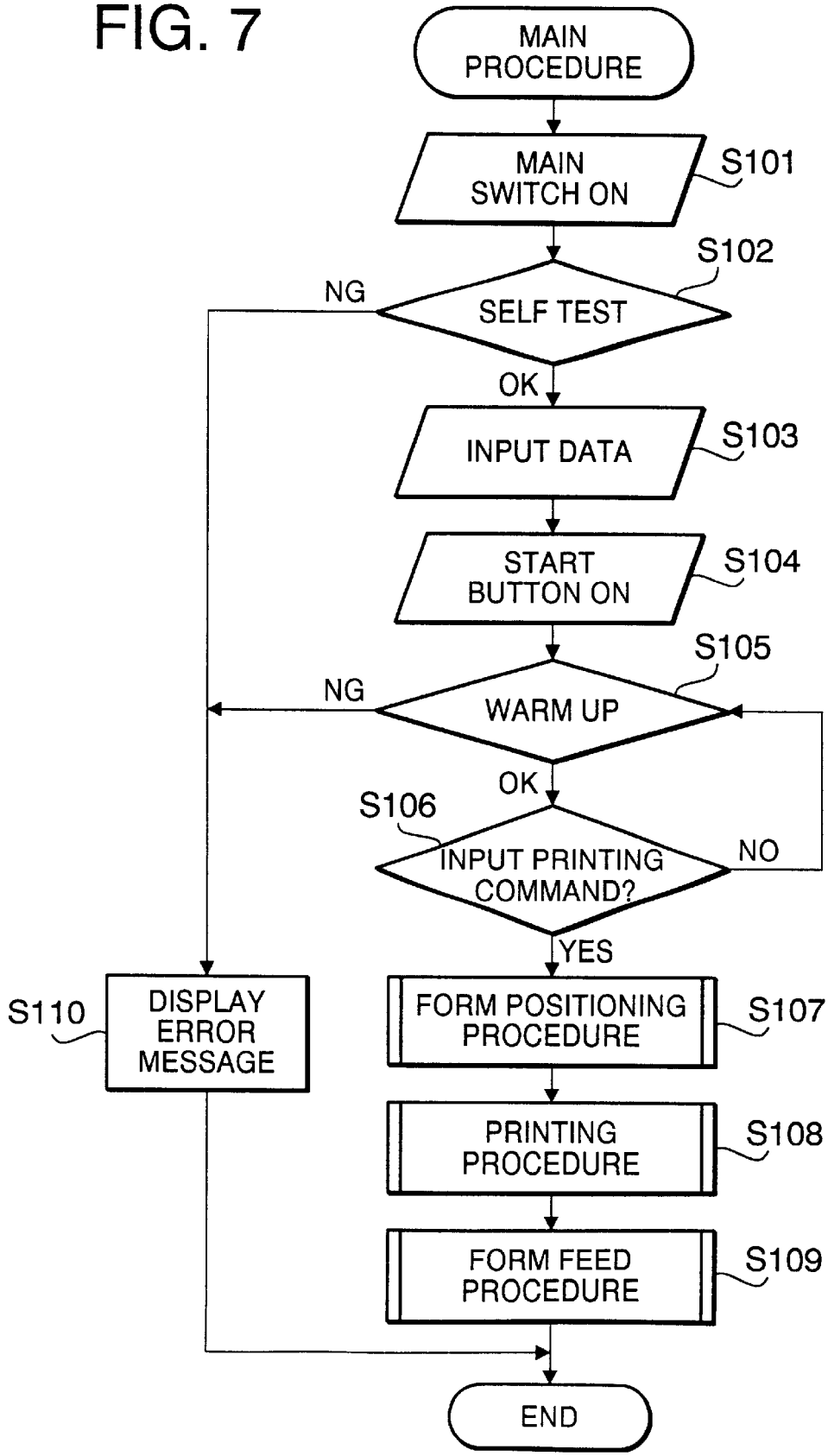
FIG. 7 is a flowchart showing a main procedure of the laser beam printer.

FIG. 7 is a flowchart showing a main procedure of the laser beam printer 10. When a main switch of the laser beam printer 10 is turned ON by a user (S101), the main procedure is initiated. In S102, a self-test is executed to decide whether the laser beam printer 10 is ready for printing. If the laser beam printer 10 is not ready for printing (S102: NG), an error message is displayed (S110) and the procedure is terminated.

If the laser beam printer 10 is ready for printing (S102: OK), the process proceeds to S103, where the user is required to input necessary information such as the length of a page of the loaded continuous recording sheet P (i.e. an interval of the perforation lines), the temperature of the heat roller 50, and the like.

When the user turns ON a start button of the laser beam printer 10 (S104), a warming up procedure starts (S105), where the halogen lamp 58 Is turned on to heat the heat roller 50. If the heat roller 50 is not heated to the temperature set up in S103 within a predetermined time period (S105: NG), then an error message is displayed (S110) and the procedure is terminated.

If the heat roller 50 is heated to the temperature set up in S103 within the predetermined time period (S105: OK), then the laser beam printer 10 remains in stand-by condition until a printing command is received (S106). If the printing command is not received (S106: NO), the process goes back to S105 to keep the temperature of the heat roller 50 at the set-up value so that printing can be executed immediately when the printing command is received.

When a printing command is received (S106: YES), control proceeds to S107, and a form positioning procedure is executed. In the form positioning procedure, the tractor 34 is actuated such that the perforation line, which is formed on the upstream side, with respect to the feeding direction, of the top page of the continuous recording sheet P is positioned to the home position D. It should be noted that the length between positions A and D of the feeding path 30 is sufficiently longer than the interval of the perforation lines (i.e., the length of a page) of any continuous recording sheet that can be used in the laser beam printer 10.

In S108, a printing procedure is executed to print images onto the continuous recording sheet P. Then, a form feed process is executed in S109 so that the printed part of the continuous recording sheet P is discharged from the outlet 12*b* after the toner image has been fixed. After the form feed process is executed, the procedure is terminated.

Figure 8:
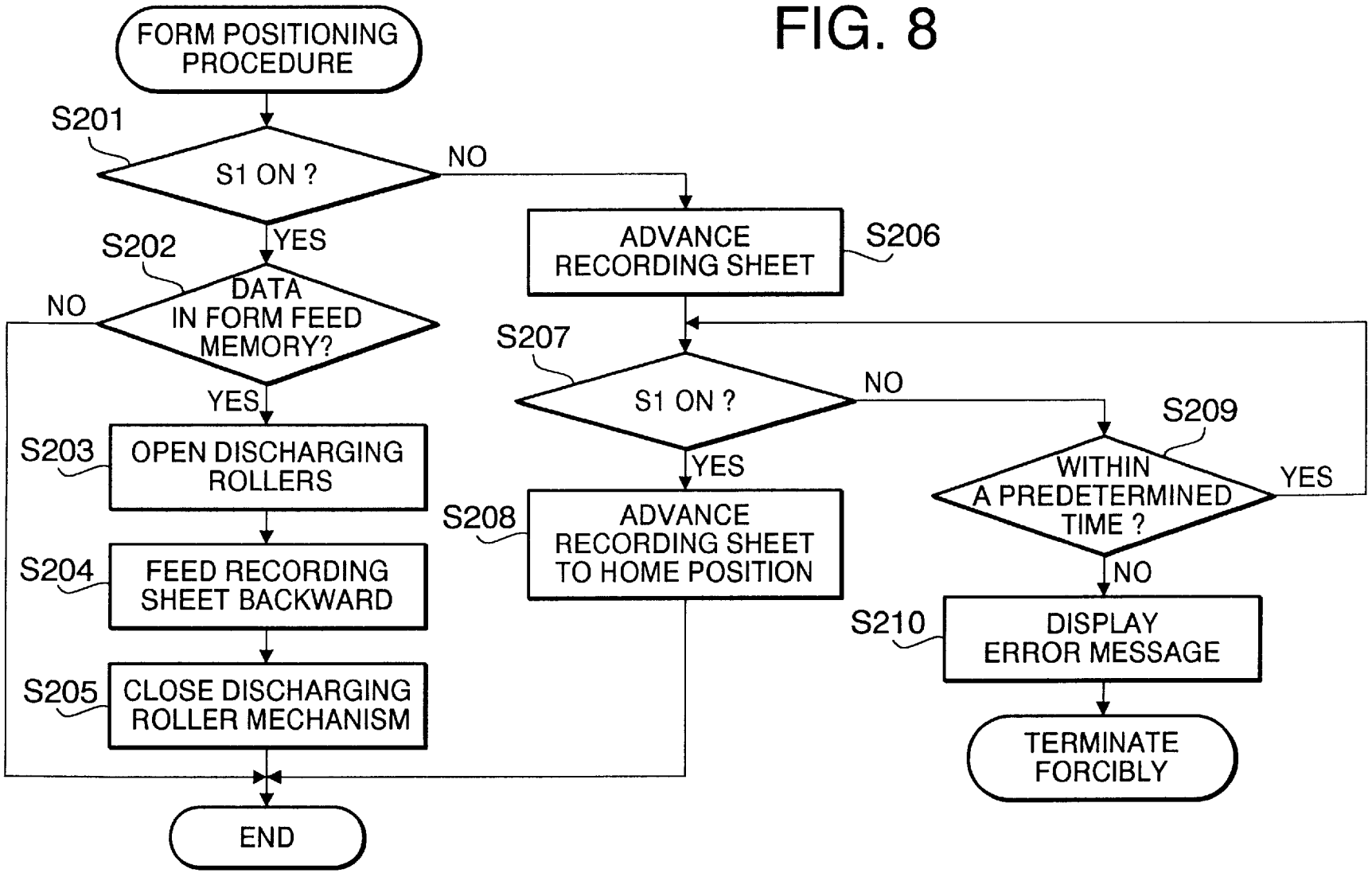
FIG. 8 is a flowchart showing a form positioning procedure.

FIG. 8 is a flowchart showing a form positioning procedure executed in S107 of FIG. 7. In this procedure, the output of the paper top sensor S1 is checked (S201). If the output of the paper top sensor S1 indicates that the continuous recording sheet P is present (S201: YES), it is checked whether data is stored in a form feed memory (S202). If no data is stored in the form feed memory (S202: NO), the perforation line formed between the top page and second page of the continuous recording sheet P is located at the home position D. Since the continuous recording sheet P is already located in position, the procedure is terminated.

If data is stored in the form feed memory (S202: YES), the perforation line between the top and second pages is somewhere downstream from the home position D in the feeding direction. In this case, the procedure in S203–S205 is executed to pull back the continuous recording sheet P. Specifically, in S203, the upper discharging roller 35*a* is lifted up and located at a position spaced from the lower discharging roller 35*b* using the roller separating device so that the discharging roller mechanism 35 does not disturb the backward movement of the continuous recording sheet P. In S204, the continuous recording sheet P is pulled back by the tractor 34 until the perforation line between the top and second pages is located at the home position D. It should be noted that the leading edge of the continuous recording sheet P is located at the cutter 37 (position C) when the procedure in S204 is started, since the form feed process, described later, has been executed. Therefore, the continuous recording sheet P should be pulled back in S204 by a distance equal to the difference of the distance between positions C and D of the feeding path 28 and the length of one page of the continuous recording sheet P.

After the continuous recording sheet P has been pulled back in S204, the upper discharging roller 35*a* is moved down to contact the lower discharging roller 35*b* (S205), and the form positioning process is terminated.

If the paper top sensor S1 does not detect the continuous recording sheet P (S201: NO), that the leading edge of the continuous recording sheet P has not yet been advanced to the home position D. In this case, the process proceeds to S206.

In S206, the tractor 34 is actuated to advance the continuous recording sheet P towards the home position D. At the same time, a timer is stared.

In S207, it is checked whether the paper top sensor S1 detects the presence of the continuous recording sheet P. If the paper top sensor S1 does not detect the presence of the continuous recording sheet P (S207: No), it is checked whether the time measured by the timer is within a predetermined time (S209). If the measured time is within the predetermined time (S209: YES), the process goes back to S207. If the measured time exceeds the predetermined time period (S209: NO), an error message is displayed (S210), and the form feeding procedure, and also the main procedure shown in FIG. 7, are terminated since an error condition such as paper jam could have been happened and the leading end of the continuous recording sheet P has not reached the home position D within the predetermined time period.

If the paper top sensor detects the presence of the continuous recording sheet P (S207: YES), the tractor 34 stops after feeding the continuous recording sheet P by a further length equal to the difference of the length of one page of the continuous recording sheet P and the distance between the paper top sensor S1 and the home position D (S208). With this control, the leading end of the continuous recording sheet P is located to the home position D. After the execution of S208, the form positioning procedure is terminated.

Figure 9:
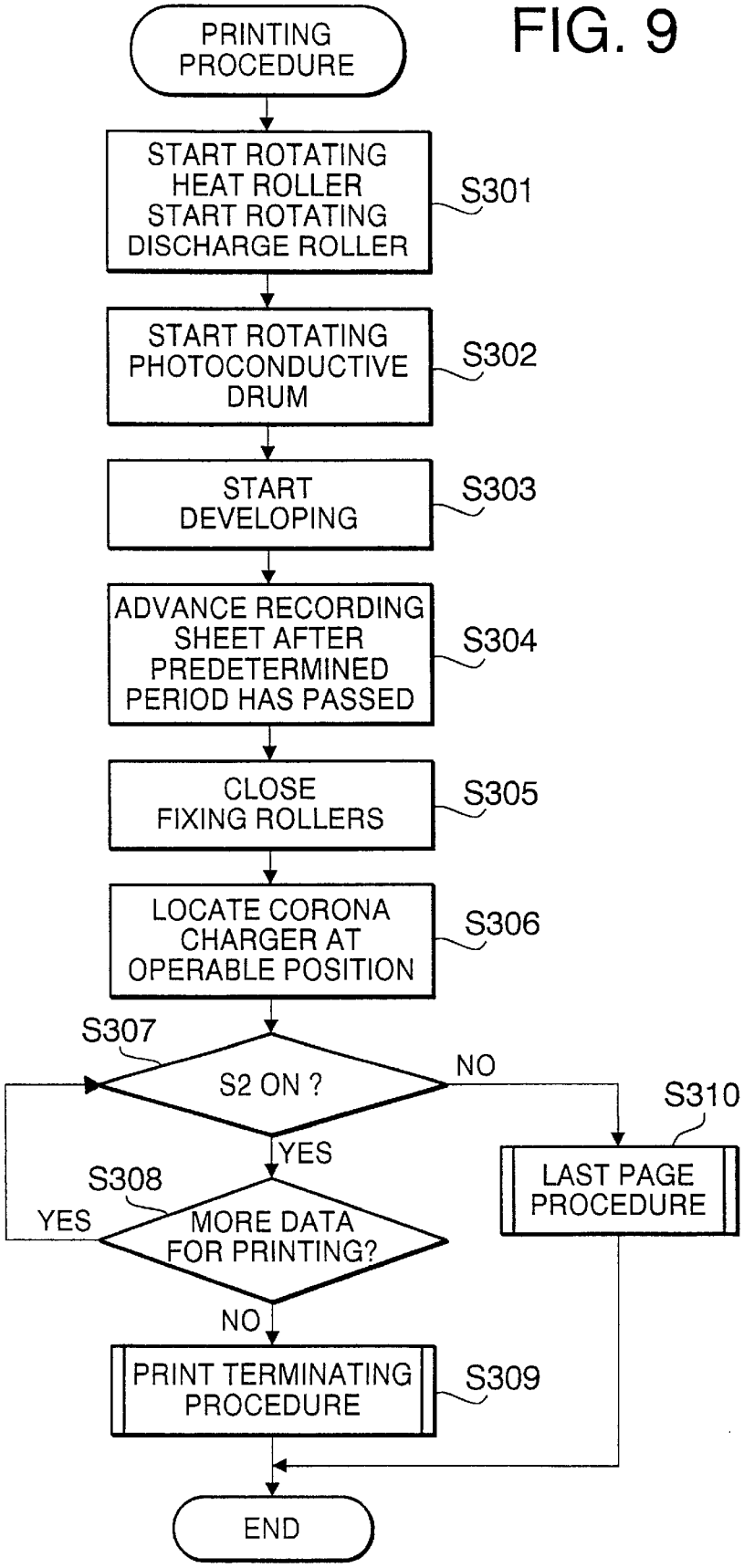
FIG. 9 is a flowchart illustrating the printing procedure.

FIG. 9 is a flowchart illustrating the printing procedure which is executed in S108 of the main procedure shown in FIG. 7. In S301 the heat roller 50 and the upper discharging roller 35*a* are driven to start rotating. Subsequently, the photoconductive drum 14 is driven to start rotating (S302). At the same time, a scanning operation for exposing the photoconductive surface of the photoconductive drum 19 is started. Then, the development of the toner image on the photoconductive drum 14 is started (S303).

Next, the tractor 34 is actuated to advance the continuous recording sheet P (S304). In S304, the tractor 34 is actuated after a predetermined time has passed so that the top of the developed image on the photoconductive drum 19 is transferred on the top of the continuous recording sheet P.

In step 305, the rotating cam 90 is rotated until the cam follower 78 contacts the rotating cam 90 at point d. As a result, the heat roller 50 contacts the pressure roller 52 at the maximum pressure.

Next, the corona charger of the transfer unit 26 is moved to the transfer position A by swinging the arm member 44 (S306). At this stage, the leading edge of the continuous recording sheet P has not yet arrived at the transfer position A.

In S307, it is judged whether the paper end sensor S2 detects the presence of the continuous recording sheet P. If the paper end sensor S2 does not detect the continuous recording sheet P (S307: NO), the last page of the continuous recording sheet P has passed the end sensor position. In such a case, the printing procedure should be terminated after executing a last page procedure in S310.

If the paper end sensor S2 detects the presence of the continuous recording sheet P (S307: YES), it is judged if there is more data for printing (5308). If there is data for printing (S308: YES), control goes back to S307. If there is no data for printing (S308: NO), the printing process is terminated after a print terminating procedure is executed (S309).

Figure 10:
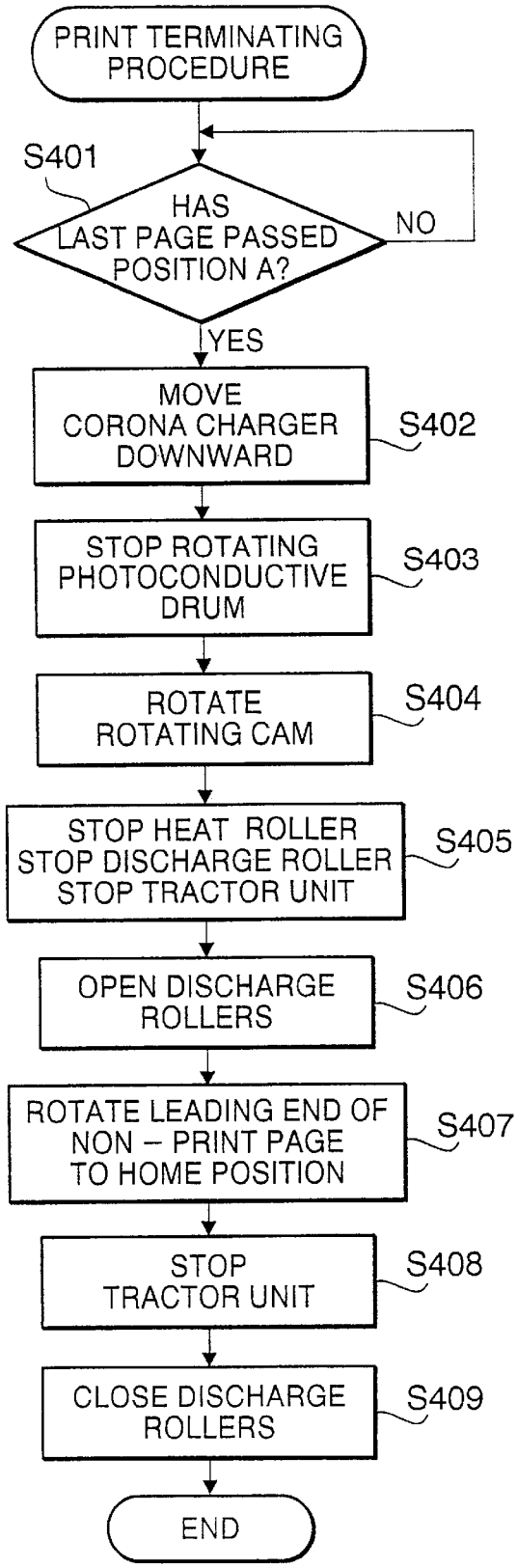
FIG. 10 is a flowchart showing the detail of the print terminating procedure.

FIG. 10 is a flowchart showing the detail of the print terminating procedure executed in S309 of FIG. 9. In this procedure, the corona charger is moved away from photoconductive drum 14 by swinging the arm member 44 after the perforation line at the trailing edge of the last page to be printed of the continuous recording sheet P has passed the transfer point A (S401: YES, S402). Then, the photoconductive drum 14 is stopped to rotate (S403).

Next, the rotation cam 90 is rotated at a constant speed to move the heat roller 50 away from the pressure roller 52 (S404). The time to start the rotation and the speed of rotation are determined such that the cam follower 78 passes the point c of the rotating cam 90 shortly after the perforation line at the trailing edge of the last printed page of the continuous recording sheet P has passed the fixing position B. The rotating cam 90 is stopped to rotate when the cam follower 78 arrives at point a of the rotating cam 90.

Next, the heat roller 50 and the upper discharging roller 35*a* are stopped to rotate and the tractor 34 is also stopped after the perforation line mentioned in S404 has arrived at the cutter 37 (point C), i.e. after the tractor 34 has fed the continuous recording sheet P by a distance equal to the distance between the points A and C along the feeding path 28 (S405). Thus, the printed pages of the continuous recording sheet are discharged from the outlet 12*b* so that the user can check them.

Next, the upper discharging roller 35*a* is lifted up to be spaced from the lower discharging roller 35*b* (S406). Then, the continuous recording sheet P is pulled back by the tractor 34 until the perforation line between the top and second pages of the non-printed part is located at the home position D (S407). That is, the continuous recording sheet P is pulled back by a distance equal to the difference of the distance from point A to D along the feeding path 28 and the length of one page of the continuous recording sheet P.

Next, the tractor 34 is stopped (S408), and the upper discharging roller 35*a* is moved down to contact the lower discharging roller 35*b* (S409). Then, the printing process is terminated.

Figure 11:
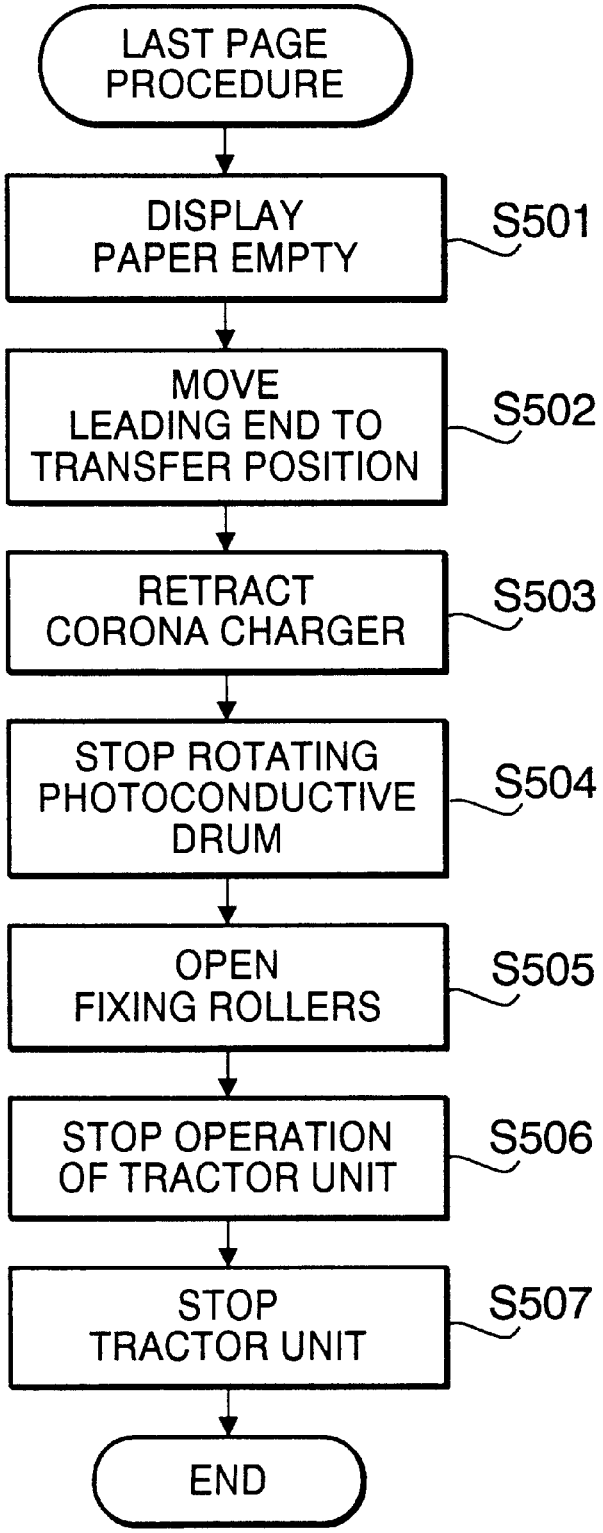
FIG. 11 is a flowchart showing the last page procedure.

FIG. 11 is a flowchart showing the last page procedure executed in S310. At the beginning of the last page process, a message of "PAPER EMPTY" is displayed (S501). Then, the corona charger is moved away from the photoconductive drum 14 by swinging the arm member 44 (S503) after the continuous recording sheet P is fed by the tractor 34 and the discharging roller mechanism 35 by a distance equal to the distance between points A and E of the feeding path 28, i.e. after the perforation line at the rear edge of the last page has arrived the transfer position A (S502).

Next, the rotation of the photoconductive drum 14 is stopped (S504). Then, the rotating cam 90 is rotated, so that the heat roller 50 is moved away from the pressure roller 52, after the perforation line at the trailing edge of the last page has arrived at the fixing point B, i.e. after the continuous recording sheet P has been advanced by a distance equal to the distance between the points B and B of the feeding path 28 since the beginning of the present routine (S505). Rotation of the rotating cam 90 is stopped when the cam follower 78 contacts the rotating cam 90 at point a.

Next, rotation of the heat roller 50 and the upper discharging roller 35*a* is stopped after the trailing edge of the last page is fed until the cutter position C, i.e. continuous recording sheet P is fed by a distance equal to the distance between the points C and E of the feeding path 28 since the beginning of the present routine. Then, operation of the tractor 34 is stopped (S506) and the tractor is stopped (S507), and the last page process is terminated.

Figure 12:
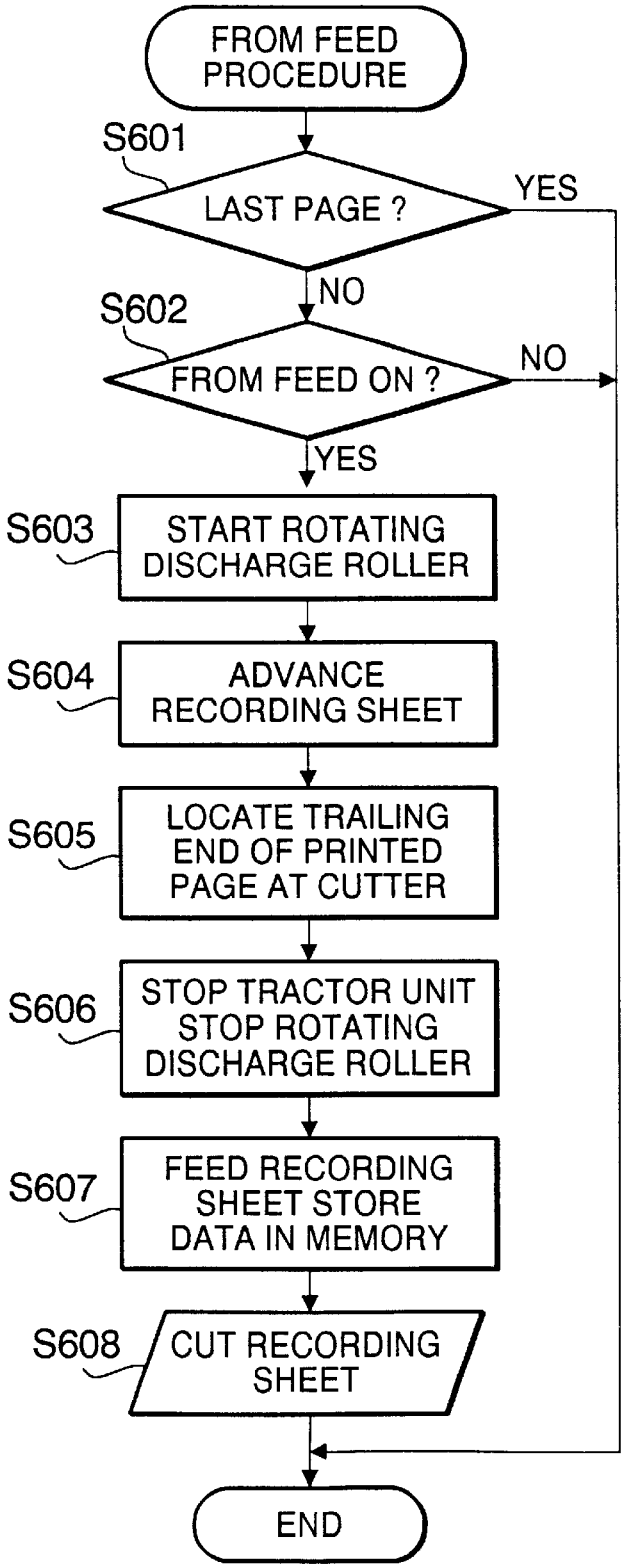
FIG. 12 is a flowchart showing the form feed procedure.

FIG. 12 is a flowchart showing the form feed procedure executed in S109 of the main procedure. At the beginning of the form feed process, it is judged whether the last page process of S310 has been executed (S601). If the last page process of step 310 has already been executed (S601: YES), this procedure will be terminated since the continuous recording sheet P is not left in the laser beam printer 10. If the last page process of S310 has not yet been executed (S601: NO), it is judged whether the user requires the form feed (S602).

If the user does not require the form feed (S602: NO), this procedure will be terminated. If the user requires the from feed (S602: YES), then the upper discharging roller 35*a* is driven to rotate (S603) and the tractor 34 starts to feed the continuous recording sheet P (S604). The tractor 34 feeds the continuous recording sheet P until the perforation line at the upstream end of the last printed page arrives the cutter position C (S605). In other words, the tractor 34 advances the continuous recording sheet P by a distance equal to the difference between the distance from the positions C to D of the feeding path 28 and the length of one page of the continuous recording sheet P. Then, the tractor 34 and the upper discharging roller 35*a* are stopped (S606).

Next, data that indicates form feed has been done is stored in the form feed memory (S607). Then, the user manipulates the cutter 37 to cut the continuous recording sheet along the perforation line at the upstream edge of the last printed page (S608). After step 608, this procedure is terminated.

Second Embodiment

The imaging apparatus according to the second embodiment will be described hereinafter. According to the second embodiment, a rotary position of a rotating cam is detected, and based on the detected position, a driving motor for rotating the rotating cam is forcibly stopped such that the heat roller 50 and the pressure roller 52 are biased against each other at a minimum pressure for the fixing operation for a predetermined period of time.

Figure 13:
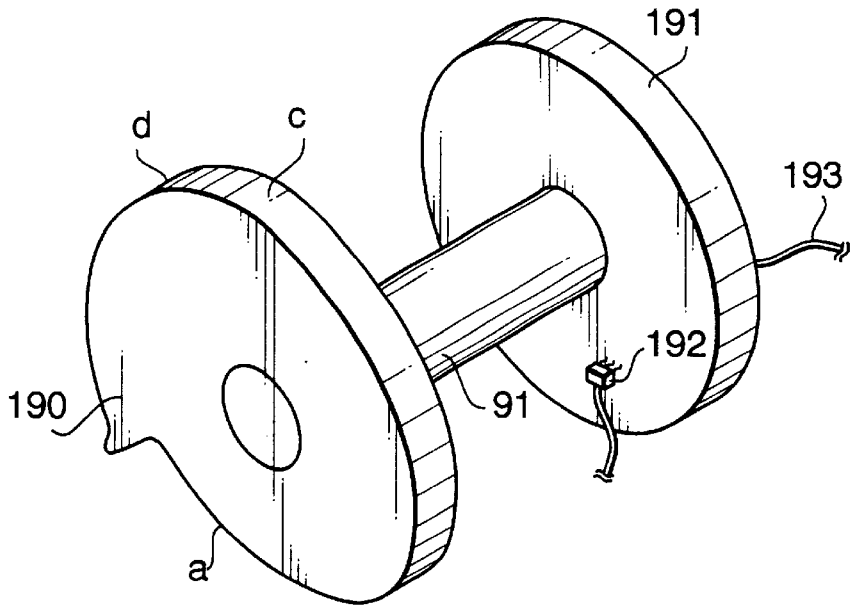
FIG. 13 shows a structure of a rotating cam, which can be employed in the imaging device shown in FIG. 1.

FIG. 13 shows a structure of a rotating cam 190, which can be employed in the imaging device shown in FIG. 1 instead of the rotating cam 90 according to the first embodiment. The profile of the cam 190 is substantially similar to that of cam 90 except that a region b-c of the cam 90 is omitted. Further, according to the second embodiment, a disk-shaped code plate 191 is secured to a cam shaft 91 so that the code plate 191 rotates integrally with the rotating cam 190.

FIG. 14 schematically shows a structure of the code plate 191. As shown in FIG. 14, on the code plate 191, conductive patterns 191*a*, 191*c* and 191*d* are formed. As shown in FIGS. 13 and 14, a brush 192 including a plurality of pin members 192*a*, 192*c* and 192*d* for respectively detecting the conductive patterns 191*a*, 191*c* and 191*d* are provided.

Specifically, when the cam follower 78 contacts the rotating cam 190 on a position within the region a, the pin member 192*a* contacts the conductive pattern 191*a*. Similarly, when the cam follower 78 contacts the rotating cam 190 at a position within the region c and d, the pin member 192*c* and 192*d* contact the conductive patterns 191*c* and 191*d*; respectively. The conductive patterns 191*a*, 191*c* and 191*d* are supplied with pull-up voltages through a code 193, and therefore, by monitoring the voltages of the pints 192*a*, 192*c* and 192*d*, the rotational position of the rotating cam 190 can be detected.

It should be noted that, in the second embodiment, when the heat roller 50 is positioned at the intermediate position between the operative position and the retracted position by forcibly stopping the driving motor so that the heat roller 50 is press-contacted with the pressure roller 52 at the minimum pressure, the cam profile of the rotating cam 190 does not have an arc-shaped region as in the cam 90. That is, a distance from the center O of the shaft 91 to the cam surface of the rotating cam 190 gradually increases from point a to c, via point b. When the cam follower 78 contacts the rotating cam 190 at point d, the heat roller 50 is biased toward the pressure roller 52 at a predetermined pressure for the fixing operation; when the cam follower 78 contacts the rotating cam 190 at point c, the heat roller 50 is biased to the cam 190 at the minimum pressure for the fixing operation; and when the cam follower 78 contacts the rotating cam 190 at point a, the heat roller 50 is completely spaced from the pressure roller 52 (i.e., the retracted position).

FIG. 15 shows a flowchart illustrating a cam driving procedure according to the second embodiment. The operation of the laser beam printer according to the second embodiment is substantially similar to that according to the first embodiment. In the second embodiment, when the heat roller 50 is maintained at the intermediate position, rotation of the rotating cam 190 is forcibly stopped. The control will be described referring to FIG. 15.

The procedure shown in FIG. 15 is executed when the heat roller 50 is started to move from the operable position to the retracted position (which corresponds to S404 of FIG. 10). In S701, a cam drive motor (not shown) is driven to start rotating the cam 190 so that the contacting portion of the cam follower 78 with respect to the cam 190 is moved from point d toward point a. In S702, it is judged whether the point c has reached the cam follower 78. Until point c reaches the cam follower 78 (S702: NO), the cam drive motor is driven to rotate the cam 190. When point c has reached the cam follower 78 (S702: YES), the cam drive motor is stopped (S703). Then, in S704, a timer is started. In S705, it is judged whether a predetermined time period has elapsed. It should be noted that the predetermined time period corresponds to a period of time during which the cam follower 78 follows the region b-c of the cam 90 (first embodiment).

When the predetermined time period has elapsed (S705: YES), the cam drive motor is started to rotate the cam 190 (S706). Until point a reaches the cam follower 78 (S707: NO), the cam 191 is kept rotating. When point a has reached the cam follower 78 (S707: YES), the cam drive motor is stopped rotating (S708), thereby rotation of cam being stopped.

The present disclosure relates to the subject matter contained in Japanese Patent Application No. 2000-278214, filed on Sep. 13, 2000, which is expressly incorporated herein by reference in its entirety.

What is claimed is:

1. An imaging apparatus for forming an image on a continuous recording sheet, in accordance with an electrophotographic imaging process, and fixing the image on the continuous recording sheet by applying heat and pressure using a pair of fixing rollers including a heat roller and a pressure roller, said imaging apparatus comprising:

a sheet feeding device which is capable of feeding the continuous recording sheet in forward and reverse directions;

a controller which controls said sheet feeding device to feed the continuous recording sheet such that, when a printing operation is terminated, said controller controls said sheet feeding device to discharge a trailing end of a printed portion of the continuous recording sheet from a predetermined position downstream of said pair of fixing rollers, said controller controls said sheet feeding device to reversely feed the continuous recording sheet so that a leading end of a non-printed portion of the continuous recording sheet is located at an upstream position with respect to a transfer position at which an image is transferred on the continuous recording sheet when another printing operation is to be started;

a roller driving mechanism which moves at least one of said heat roller and pressure roller so that said heat roller and pressure roller move between an operable position where said heat roller is press-contacted with said pressure roller and a retracted position where said heat roller is spaced from said pressure roller, said controller controls said roller driving mechanism to locate said heat roller and said pressure roller to the retracted position when the printing operation is terminated, said controller controls said roller driving mechanism such that said at least one of said heat roller and pressure roller stays at at least one intermediate position between said operable position and said retracted position for a predetermined period of time when said at least one of said heat roller and pressure roller is moved from said operable position and said retracted position; and said at least one intermediate position including a position at which said heat roller and said pressure roller contact the recording sheet, a portion close to the trailing end of the printed portion of the continuous recording sheet passing through a nip between said heat roller and said pressure roller located at said at least one intermediate position.

2. The imaging apparatus according to claim 1, said roller driving mechanism including a pair of arm members swingable about an axis, said one of said heat roller and pressure roller being supported at an end portion of said pair of arm members, said one of said heat roller and pressure roller being swung as said pair of arm members swing about said axis.

3. The imaging apparatus according to claim 2, said roller driving mechanism including a cam mechanism which includes:

a rotating cam which is rotatable about a rotation axis; and a cam rotating system that rotates said rotating cam at a predetermined constant speed, said rotating cam being formed to have an arc-shaped cam portion, which is centered about said rotation axis.

4. The imaging apparatus according to claim 2, said roller driving mechanism including a cam mechanism, which includes:

a cam member formed with a cam profile;

a driving system that drives said cam member to move;

a cam position detecting system that detects a position of said cam member; and a control system that controls movement of said cam member, said control system controls said driving system to stop driving said cam member for a predetermined period of time when said cam position detecting system detects that said cam member is located at a predetermined position.

5. The imaging apparatus according to claim 1, which performs image formation on a page basis, the page being defined as a segment on the recording sheet divided by perforation lines formed thereon at predetermined intervals.

* * * * *